US006955183B2

(12) United States Patent
McCarthy

(10) Patent No.: US 6,955,183 B2
(45) Date of Patent: Oct. 18, 2005

(54) PRESSURE TANK VALVE SOCKET

(76) Inventor: David McCarthy, 4022 Clover St., Rapid City, SD (US) 57702

( * ) Notice: Subject to any disclaimer, the term of this patent is extended or adjusted under 35 U.S.C. 154(b) by 108 days.

(21) Appl. No.: 10/791,182

(22) Filed: Mar. 2, 2004

(65) Prior Publication Data

US 2005/0194045 A1 Sep. 8, 2005

(51) Int. Cl.[7] ..... B25B 13/00; B25B 13/06; F16K 31/32; F16K 51/00

(52) U.S. Cl. ..... 137/315.41; 29/221.6; 81/124.2; 81/125; 81/176.15

(58) Field of Search ..... 29/213.1, 221.6, 29/700, 890.121; 81/124.2, 124.3, 125, 176.15; 7/138; 137/15.18, 315.41, 454.2, 454.5, 454.6, 137/614.2; 251/291, 292

(56) References Cited

U.S. PATENT DOCUMENTS 729,672 A * 6/1903 Sack ..... 251/292
1,181,565 A * 5/1916 Block ..... 81/124.2
1,599,098 A * 9/1926 Mix ..... 137/315.41
3,947,942 A * 4/1976 Blocker ..... 137/315.41
4,016,783 A * 4/1977 Spector et al. ..... 81/125
6,062,110 A * 5/2000 Julio et al. ..... 81/124.2
6,609,445 B2 * 8/2003 Elmore ..... 81/124.2

OTHER PUBLICATIONS

Kings Supply Company, Huskie-1, One-Eyed Huskie Standard Propane Valve Wrench, An Internet Advertisement, www.kingsupply.com/item28.htm.*

* cited by examiner

*Primary Examiner*—George L. Walton
(74) *Attorney, Agent, or Firm*—Gene R. Woodle

(57) ABSTRACT

Embodiments of a pressure tank valve socket are disclosed which may be used to safely remove the valve from a propane or other pressure tank without damaging the valve. The pressure tank valve socket applies force only to the sturdiest part of the valve and, thus, prevents injury to the more delicate parts of the valve.

1 Claim, 3 Drawing Sheets

PRESSURE TANK VALVE SOCKET

BACKGROUND OF THE INVENTION

1. Field of the Invention

The present invention relates generally to tanks holding pressurized gasses such as propane and more specifically to tool for removing valves from such tanks.

2. Background Information

All around the United States and throughout the world, hundreds of thousands of people use compressed gas stored in metal, usually steel, tanks. Perhaps the most common of these uses is the use of "bottled" propane in familiar steel tanks. Propane is used for a variety of purposes including barbecue grills, powering forklifts, and as a heating and cooking fuel for recreational vehicles. Although propane tanks are referenced in the following descriptions, the pressure tank valve socket of the instant invention could be easily adapted for use with a variety of pressure tank types.

In the United States and in many other countries, the construction of propane tanks and valves and the filling of such tanks is highly regulated. One consequence of such regulations is that the valve on a propane tank is usually protected by a metal guard which surrounds much of the valve. In most cases, such valves are threaded and screw into a receptor on the tank. In addition, most valves are manufactured of a relatively soft metal such as brass to insure that all threaded fastenings fit tightly. Periodically propane tank valves must be removed for repair or replacement. Because of the guard which surrounds the valve and because the valve is made of soft material; it is very difficult, if not impossible, to get a conventional wrench into a position in which it may be used to remove the valve without causing damage to the valve.

The invention presented in the present application is believed to solve, in a simple and effective fashion, problems which have long plagued persons attempting to remove a valve from any of a variety of compressed gas tanks such as propane tanks: a inexpensive and effective tool for easily removing the valve from such a tank without damaging the valve.

The ideal pressure tank valve socket should provide a tool for easily and efficiently removing (or attaching) a valve from a pressurized gas tank. The ideal pressure tank valve socket should also be configured to avoid damage to the valve of such a tank. The ideal pressure tank valve socket should also be simple, inexpensive, rugged, and easy to use.

SUMMARY OF THE INVENTION

The pressure tank valve socket of the instant invention is a tool for easily and safely removing the valve from a receptor on a propane tank without damaging the valve. The valve typically has a rotating control handle to control the flow of gas through the valve and a threaded male end or connector which screws into the receptor on the tank. Typically, a safety valve (in many cases referred to as an overfill protection device or OPD) protrudes at a right angle from the axis between the handle and the connector and a regulator connector protrudes from the valve opposite and a bit above the safety valve. Although there is some small variation in valves, the valves have parallel, opposed shoulders on either side of the valve between the safety valve and the regulator connector. In some cases, the handle may be removed and in some cases the handle is fixed. Some propane tanks, such as those used for recreational vehicles, have removable handles and an external regulator connector.

The pressure tank valve socket of the instant invention is essentially a large socket which works on the same principle as the well known socket and handle arrangement. The unique and original features of the pressure tank valve socket involve a configuration which allows the socket to fit over the handle (if the particular valve has a fixed handle), the safety valve, and the regulator connector without bearing upon any of those elements. The pressure tank valve socket is configured such that the socket bears upon only the two shoulders found in the valve. These shoulder elements are the most sound elements of the valve, and the most capable of handling the turning pressure necessary to remove or attach the valve.

The pressure tank valve socket of the instant invention fits over the valve inside the guard and engages the shoulder elements. The free end of the pressure tank valve socket includes a hex head stud which may be engaged by a conventional socket set handle, a conventional wrench, or similar device and used to remove or attach the valve from or to the propane tank. Because only the shoulders are engaged, the relatively fragile safety valve and regulator connector are never damaged when removing or attaching a valve.

The pressure tank valve socket has three basic embodiments. One is used for a barbecue type tank with a fixed handle; one is used for the type of tank which is used, for instance, to power a forklift and which has a removable handle; the third type is used, for instance, in a recreational vehicle and has an external regulator connector.

One of the major objects of the pressure tank valve socket of the present invention is to provide a tool for easily and efficiently removing (or attaching) a valve from a pressure tank.

Another objective of the present invention is to be configured to avoid damage to the pressure tank valve.

Another objective of the present invention is to provide a pressure tank valve socket which is simple, inexpensive, and easy to use.

These and other features of the invention will become apparent when taken in consideration with the following detailed description and the drawings.

DESCRIPTION OF A PREFERRED EMBODIMENT

Figure 1:
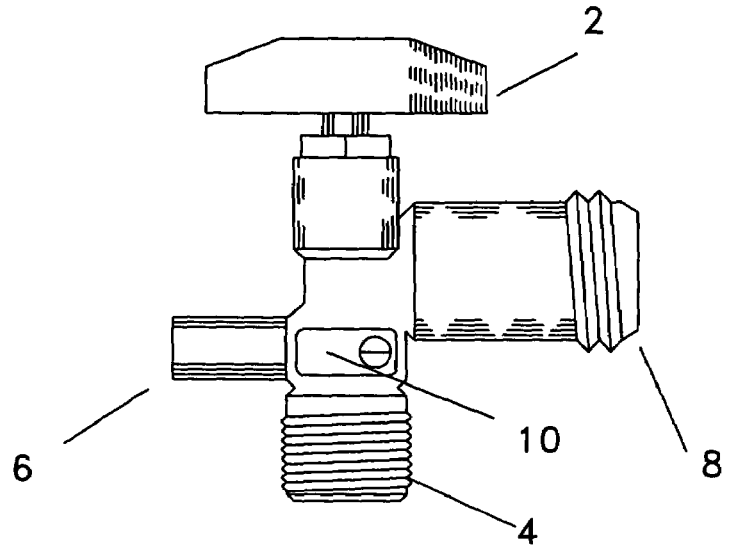
FIG. 1 is a side view of a typical propane tank valve.
Figure 2:
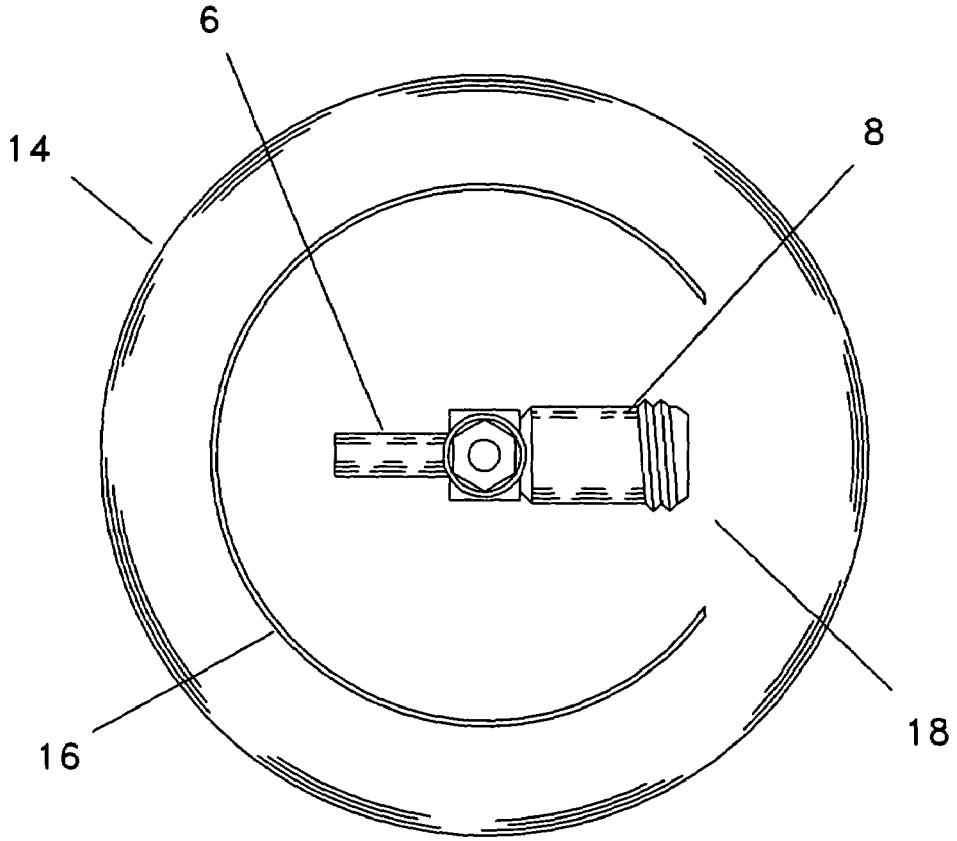
FIG. 2 is a top view of a typical propane tank valve attached to a typical propane tank.
Figure 3:
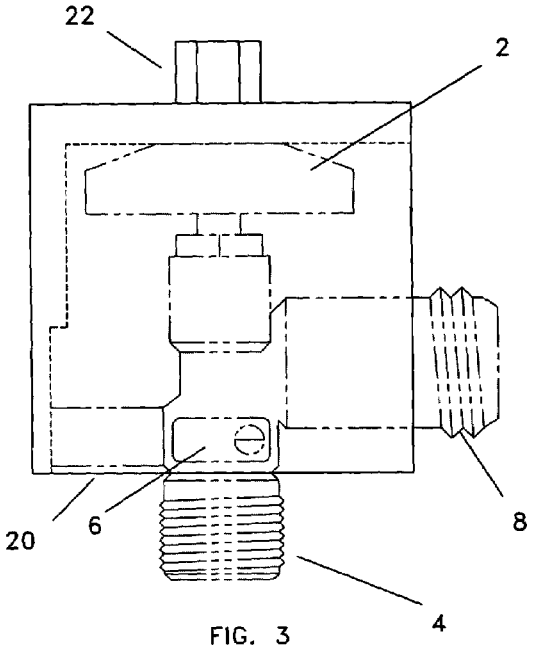
FIG. 3 is a side view of an embodiment of the pressure tank valve socket of the instant invention for use with valves having fixed handles.
Figure 4:
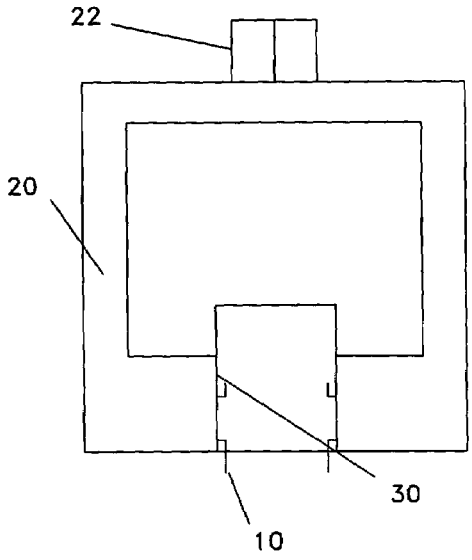
FIG. 4 is a front view of an embodiment of the pressure tank valve socket of the instant invention for use with valves having fixed handles.
Figure 5:
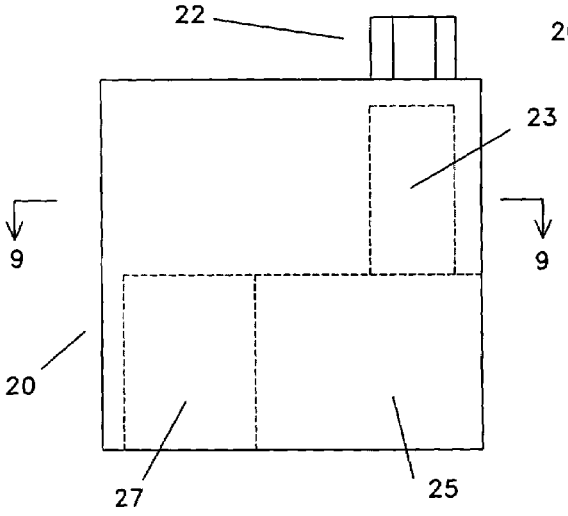
FIG. 5 is a side view of an embodiment of the pressure tank valve socket of the instant invention for use with valves having removable handles and external regulator connectors.
Figure 6:
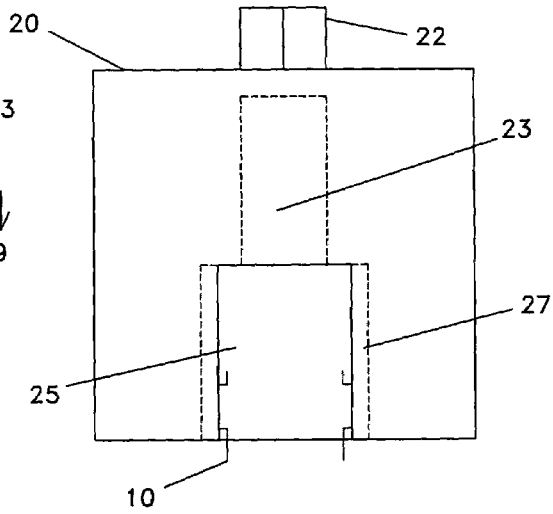
FIG. 6 is a front view of an embodiment of the pressure tank valve socket of the instant invention for use with valves having removable handles and external regulator connectors.
Figure 7:
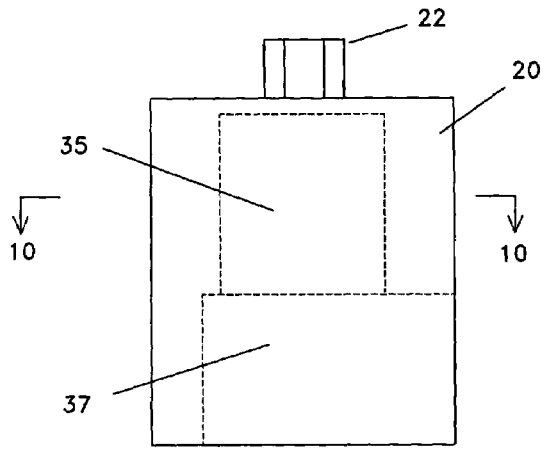
FIG. 7 is a side view of an embodiment of the pressure tank valve socket of the instant invention for use with valves having removable handles.
Figure 8:
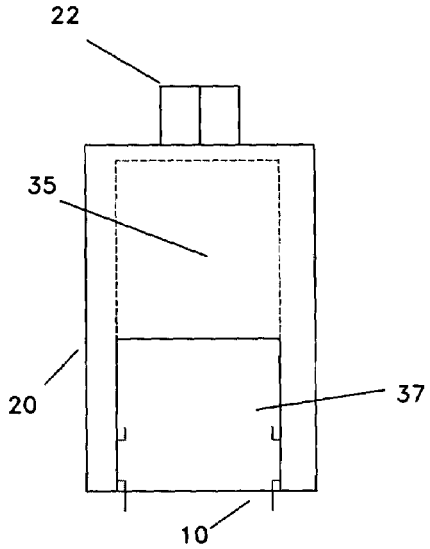
FIG. 8 is a front view of an embodiment of the pressure tank valve socket of the instant invention for use with valves having removable handles.
Figure 9:
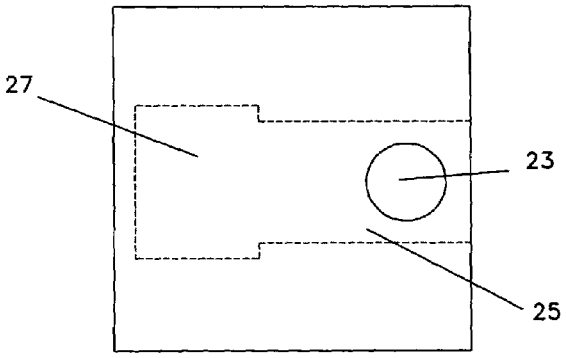
FIG. 9 is a sectional view of an embodiment of the pressure tank valve socket of the instant invention for use with valves having removable handles and external regulator connectors taken along line 9—9 of FIG. 5.
Figure 10:
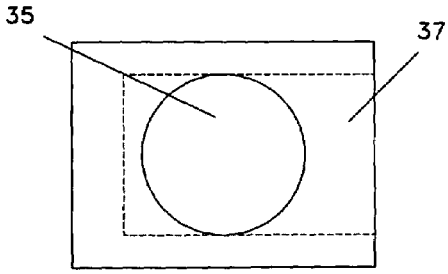
FIG. 10 is a sectional view of an embodiment of the pressure tank valve socket of the instant invention for use with valves having removable handles taken along line 10—10 of FIG. 7.

Referring to the drawings, FIGS. 1 through 10, there are shown three preferred forms of the pressure tank valve socket embodying the present invention. FIGS. 1 and 2 show a typical valve and propane tank. FIGS. 3 and 4 show an embodiment of the instant invention for use with valves having fixed handles; FIGS. 5 and 6 show an embodiment of the instant invention for use with valves having removable handles and external regulator connectors which are typically used with recreational vehicles; FIGS. 7 and 8 show an embodiment of the instant invention for use with valves having removable handles which are typically found in implements such as fork lifts; FIG. 9 is a sectional view of the socket shown in FIG. 5, and FIG. 10 is a sectional view of the socket shown in FIG. 7.

Now referring to FIG. 1, a typical propane valve is shown. For purposes of this application, the configuration of a common, barbecue grill, type propane tank and valve will be used for illustration. Again, although propane tanks are referenced in this description, the pressure tank valve socket of the instant invention could be used with a variety of pressure tank valves. In this configuration, the valve sits upright and is attached to the top of the propane tank.

The valve has a handle 2, which is used to turn on or shut off the flow of propane through the valve. On the bottom of the valve, opposite the handle, is a connector 4, which is threaded and may be attached to the propane tank by turning the threads within complementary threads in a receptor on the top of the tank. Propane valves typically have a safety valve 6 which protrudes outward from the valve body at a right angle to the axis between the handle 2 and the connector 4 and which is much closer to said connector 4 than to said handle 2. The safety valve 6 has a diameter which is smaller than the diameter of said connector 4. A regulator connector 8 protrudes from the valve body at 180 degrees from said safety valve 6 and is between said safety valve 6 and said handle 2. The diameter of the regulator connector 8 is larger than the diameter of said connector 4. A shoulder 10 protrudes from the valve body perpendicular to said safety valve 6 and said regulator connector 8 and is approximately aligned with said safety valve 6. There is a second shoulder 10 (not shown) opposite said shoulder 10 which is shown. Said shoulders 10 are parallel, planar surfaces which are also parallel to the longitudinal axis of said connector 4 and are, typically, aligned with the longitudinal axis.

Now referring to FIG. 2, a top view of a typical valve and propane tank is shown. In this figure said handle 2 has been removed for clarity; but, in a very common configuration, the handle is not removable. The tank 14 is typically cylindrical with a rounded top and bottom. The valve is connected to the tank by threading said connector 4 into complimentary threads on the top of the tank 14. Said tank 14 includes a cylindrical guard 16 which protrudes upward from the top of the tank and encloses said valve except for and opening 18 which allows access to said regulator connector 8. For purposes of this description, said regulator connector 8 is considered rearward and said safety valve 6 is considered forward.

Now referring to FIG. 3, a side view of an embodiment of the pressure tank valve socket of the instant invention is shown. This embodiment is used to remove a propane tank valve of the type which has a fixed handle. The typical valve is shown, in this figure, with phantom lines. The pressure tank valve socket includes a socket 20 having a rectangular cross section. A hex head 22 having a hexagonal shape protrudes from the top of the socket 20 and may be engaged with a conventional wrench or socket set handle. Said socket 20 is enclosed in forward and open in the rear. The upper portion of said socket 20 is hollow with a rectangular cross section and large enough to accommodate said handle 2. The bottom of said socket 20 is also hollowed out, but in a rectangular cross section having a width slightly larger than the distance between the outer surfaces of said shoulders 10 such that it fits over, but engages said shoulders 10. This rectangular hollowed out section is of sufficient length to accommodate said safety valve 6.

Now referring to FIG. 4, a front view of the embodiment of the pressure tank valve socket shown in FIG. 3 is shown. The inner surfaces of the rectangular hollowed out section of said socket 20 form opposing bearing surfaces 30 which engage the outer surfaces of said shoulders 10. The top of said handle 2 (not shown) engages the top inner surface of said socket 20 and hold it in place. A conventional wrench, socket set handle, or other means may be used to engage the hex head 22 and twist the valve onto or away from said tank 14. Because neither said safety valve 6 nor said regulator connector 8 are engaged by said socket 20, those relatively fragile parts are protected and can not be damaged during valve removal or attachment. Said hex head 22 is aligned with and opposite to the bearing surfaces 30.

Now referring to FIG. 5, a side view of an embodiment of the pressure tank valve socket of the instant invention is shown for use with valves which have a handle which may be removed and an external regulator connector. This embodiment also has said socket 20 and said hex head 22. In this embodiment said socket 20 is also hollow; but, because said handle 2 has been removed, this hollow does not need to be large enough to accommodate said handle 2. This embodiment includes three hollow sections, two having rectangular cross sections and one having a circular cross section. The topmost hollow 23 is the circular one and is configured to accommodate the handle fixture from which said handle 2 has been removed. Beneath the topmost hollow 23 is a first rectangular hollow 25 which is open to the rear and is just wide enough to engage said shoulders 10 (see FIG. 6) on the valve. A second rectangular hollow 27 is forward of the first rectangular hollow 25 and is wide enough to accommodate the safety valve 6 (not shown) of the valve. The configuration of these hollows may be better seen in FIG. 6.

This pressure tank valve socket also has a hex head 22 protruding upward from its top surface and aligned with said connector 4 (not shown).

Now referring to FIG. 6, a front view of an embodiment of the pressure tank valve socket of the instant invention the same as shown in FIG. 5 is shown. The bottom of said socket 20 is essentially open. The second rectangular hollow 27 encloses but does not engage said safety valve 8. Said first rectangular hollow 25 is wide enough to fit over and engage said shoulders 10 which is also wide enough to allow said regulator connector 8 (not shown) to fit through the opening in the rear of said first rectangular hollow 25. In operation, the pressure tank valve socket is placed over the valve with said first rectangular hollow 25 engaging said shoulders 10 and the top mounting fixture for said handle 2 contacting the top inner surface of said socket 20 for stability. Said socket 20 my then be turned using said hex head 22 to attach or remove the valve.

Now referring to FIG. 7, a side view of an embodiment of the pressure tank valve socket of the instant invention is shown for use with valves which have a handle which may be removed is shown. Said hex head 22 and said socket 20 are very similar in this embodiment to the previously discussed two embodiments; however, the various hollows are configured to accommodate the different valve configuration. A fixture hollow 35 is circular in cross section and large enough to accommodate a handle fixture near the top of the inside of said socket 20. A bearing hollow 37 is below the fixture hollow 35 and is just wide enough to fit over and engage said shoulders 10 (see FIG. 8) on the valve.

Now referring to FIG. 8, a front view of an embodiment of the pressure tank valve socket of the instant invention the same as in FIG. 7 is shown. Again, all of the parts of the valve are enclosed, but not engaged except for said shoulders 10. The bearing hollow 37 again encloses and engages said shoulders 10 and a wrench, socket set handle, or other means may be used to remove or attach the valve with said socket 20.

Now referring to FIG. 9, a sectional view of the pressure tank valve socket of the embodiment shown in FIG. 5 is shown. This view shows the sizes and relative positions of said first rectangular hollow 25, said second rectangular hollow 27, and said topmost hollow 23.

Now referring to FIG. 10, sectional view of the pressure tank valve socket of the embodiment shown in FIG. 7 is shown. This view shows the sizes and relative positions of said fixture hollow 35 and said bearing hollow 37.

In all embodiments, the pressure tank valve socket of the instant invention is made from forged steel, but other materials having sufficient strength and rigidity could be used.

While preferred embodiments of this invention have been shown and described above, it will be apparent to those skilled in the art that various modifications may be made in these embodiments without departing from the spirit of the present invention.

I claim:

1. A pressure tank valve socket to remove or attach the valve on a pressure tank where the pressure tank has a valve receptor and the valve has a threaded connector for affixing the valve to the valve receptor and the valve includes a pair of opposed shoulders which are planar surfaces parallel to each other and to the longitudinal axis of said valve receptor comprising:

(1) a hollow socket configured such that it is capable of completely surrounding the entire body of the valve and having a closed end and an open end;

(2) the open end of the hollow socket having a pair of opposed bearing surfaces which are parallel to each other and capable of fitting over and engaging the shoulder of said valve; and (3) turning engagement means affixed to the outer surface of said hollow socket opposite the opposed bearing surfaces such that turning means may be engaged with the turning engagement means to turn said hollow socket in either direction;

whereby the pressure tank valve socket has said hollow socket which may be placed over the body of said valve on a pressure tank accomodate different valve configurations or types, said opposed bearing surfaces on said hollow socket may engage the opposed shoulders of said valve, and turning means such as a wrench may be engaged with said turning engagement means to remove or attach said valve from or to said pressure tank.

* * * * *